United States Patent [19]

Butters et al.

[11] Patent Number: 4,902,577

[45] Date of Patent: Feb. 20, 1990

[54] INKABLE SHEET

[75] Inventors: Alan Butters, Ipswich; Roger N. Barker, Clacton-On-Sea; Graham A. Page, Ipswich, all of England

[73] Assignee: Imperial Chemical Industries PLC, London, England

[21] Appl. No.: 10,487

[22] Filed: Feb. 3, 1987

[30] Foreign Application Priority Data

Feb. 3, 1986 [GB] United Kingdom ..... 8602594

[51] Int. Cl.[4] ..... B41M 5/00

[52] U.S. Cl. ..... 428/483; 346/135.1; 428/195; 428/207; 428/323; 428/324; 428/328; 428/522

[58] Field of Search ..... 346/135.1; 428/195, 428/207, 211, 323, 324, 328, 483, 522, 913, 914, 480

[56] References Cited

U.S. PATENT DOCUMENTS

| | | | |
|---|---|---|---|
| 2,622,991 | 12/1952 | Sturm | 428/480 |
| 3,560,417 | 2/1971 | Pizzi | 428/480 |
| 4,371,582 | 2/1983 | Sugiyama et al. | 428/511 |
| 4,474,850 | 10/1984 | Burwasser | 428/331 |
| 4,528,242 | 6/1985 | Burwasser | 428/413 |
| 4,542,059 | 9/1985 | Toganoh et al. | 428/318.4 |
| 4,555,437 | 11/1985 | Tanck | 427/146 |
| 4,680,235 | 7/1987 | Murakami et al. | 428/478.2 |

FOREIGN PATENT DOCUMENTS

| | | | |
|---|---|---|---|
| 2312371 | 12/1976 | France | 428/480 |

*Primary Examiner*—Pamela R. Schwartz

*Attorney, Agent, or Firm*—Cushman, Darby & Cushman

[57] ABSTRACT

An inkable sheet comprises a base sheet, such as a PET film, having on a surface thereof an ink-absorbent resin layer comprising an acrylic or methacrylic polymer containing free carboxylic acid groups and a plasticizer therefor.

8 Claims, 1 Drawing Sheet

INKABLE SHEET

BACKGROUND OF THE INVENTION (a) Technical Field of Invention

This invention relates to an inkable sheet, and, in particular, to a sheet suitable for use with a mechanical printing assembly, such as an ink jet printer or a pen plotter.

(b) Background of the Art

With the recent proliferation of micro-computers and colour monitors there has been a massive growth in the amount of information available for display in colour. Presentation of such information has created a demand for hard copy, for example—on paper sheets, but increasingly on transparent polymeric films which are capable of serving as imaged transparencies for viewing in a transmission mode. Preparation of the desired hard copy is conveniently effected by, for example, an ink jet printer or a pen plotter, using an aqueous or an aqueous-organic solvent-based ink.

Ink jet printing is already established as a technique for printing variable information such as address labels, multi-colour graphics, and the like. A simple form of ink jet printer comprises a capillary tube coupled to an ink reservoir and a piezo-electric element which, on application of a voltage pulse, ejects an ink droplet from the capillary tube at high velocity (e.g. up to 20 $ms^{-1}$) onto an ink-receptive sheet. Movement of the ink jet may be computer controlled, and new characters may therefore be formed and printed at electronic speeds. To derive advantage from this high speed operating capability requires the use of an ink-receptive sheet which will quickly absorb the high velocity ink droplet without blotting or bleeding. Although plastics sheets may be employed, these generally tend to exhibit inferior ink absorption and retention characteristics. In particular, drying of an applied ink pattern is slow, and immediate handling of a freshly imaged sheet is therefore prevented.

Pen plotter assemblies are extensively used in drawing offices, and particularly in the generation of computer aided designs. The advent of polymeric recording sheets has revealed that the formation thereon of inked images of acceptable quality usually requires the development of special, and expensive, pens. However, an inkable sheet according to the invention permits the use of a simple, inexpensive, fibre-tipped, aqueous based or hydrophilic ink, pen of the kind hitherto conventionally used with paper recording sheets.

(c) The Prior Art

Various recording sheets have been proposed for use with ink jet printers. In particular, U.S. Pat. No. 4,474,850 discloses an ink jet recording transparency said to be capable of being wetted by and absorbing coloured, water-soluble inks to provide high density images which are smear resistant, the transparency comprising:

(a) a substantially transparent resinous support, such as a polyester or polyvinyl chloride film, and (b) a substantially clear coating which includes a carboxylated, high molecular weight polymer or copolymer or salts thereof.

The carboxylated polymer or copolymer coating particularly comprises monomers of acrylic or methacrylic acid and esters thereof, vinyl acetates or styrenated acrylics, and usually has a molecular weight of from about 50,000 to 1 million. We have observed that an inked pattern applied to such a film transparency is relatively slow to dry, and that such transparencies are particularly susceptible to curling whereby a pattern applied thereto appears distorted when viewed as a transmission image.

We have now devised an inkable sheet which is particularly suitable as a recording sheet for use with a mechanical printing assembly, such as an ink jet printer or a pen plotter, the sheet exhibiting an improved rate of ink absorption, a reduced tendency to curl, and an improved resistance to moisture.

SUMMARY OF THE INVENTION

Accordingly, the present invention provides an inkable sheet comprising a base sheet having on a surface thereof an ink-absorbent polymeric resin layer comprising an acrylic or methacrylic polymer containing free carboxylic acid groups and a plasticiser therefor.

The invention also provides a method of preparing an inkable sheet comprising applying to a surface of a base sheet a coating medium comprising an acrylic or methacrylic polymer containing free carboxylic acid groups and a plasticiser therefor, and drying the applied coating medium to yield a substantially water-insoluble, ink-absorbent, polymeric layer on a surface of the base sheet.

DETAILED DESCRIPTION AND PREFERRED EMBODIMENTS OF THE INVENTION

The ink-absorbent layer permits rapid drying of an applied inked pattern, and is desirably such that an aqueous-diethylene glycol (50:50 w/w) based ink, or similar composition, applied to the coated surface of a sheet will be none sticky and resistant to off-setting when the inked surface is placed in contact with the surface of a paper sheet within a few (for example, 15) minutes of application of the ink. Desirably, the applied ink should be absorbed by the absorbent layer to an extent such that smudging does not occur on rubbing with a finger within 50 seconds, and preferably within 30 seconds of application of the ink.

An inkable sheet according to the invention is of particular utility in the production of an imaged transparency for viewing in a transmission mode, as for example in association with an overhead projector in which a light source is positioned behind a sheet bearing an inked image and the image is observed from the image side by light transmitted through the sheet. Desirably, therefore the resin layer should be such that the non-inked layer is initially transparent, i.e. substantially non-light-scattering.

The acrylic or methacrylic carboxylic polymer component of the resin layer may be a homopolymer—such as, a polymer of acrylic acid or methacrylic acid, or a copolymer thereof together with a monomer not containing free carboxylic groups—such as, a lower alkyl (1 to 6 carbon atoms) acrylic or methacrylate ester. A particularly suitable ink absorbent resin comprises a copolymer of methacrylic acid and methyl methacrylate, the copolymer having an acid value (mg KOH per g) of from about 400 to 450, especially from 410 to 430, and a molecular weight (weight average) of from about 80,000 to 120,000 and particularly of about 100,000.

The plasticiser blended with the ink absorbent carboxylic polymer resin is suitably any additive which may be incorporated into a polymeric material to improve its softness, processability and flexibility. They are well known per se in the plastics art, particularly for modifying the characteristics of polyvinyl chloride, and are usually organic materials in the form of moderately high molecular weight liquids or low melting solids. Most commonly they comprise esters of carboxylic acids or phosphoric acid, although hydrocarbons, halogenated hydrocarbons, ethers, glycols, polyglycols and hydrogenated or expoxydised drying oils (e.g. soya bean oil) may also be employed. Typical aromatic plasticisers include aromatic esters particularly phosphoric esters such as triphenyl phosphate, and phthalic esters such as dibutyl phthalate or dicyclohexyl phthalate, while aliphatic plasticisers include aliphatic esters, particularly adipic esters such as diisooctyl adipate, azelaic esters such as di(2-ethylhexyl)azelate, sebacic esters such as dioctyl sebacate, and citric esters such as acetyl tributyl citrate. A preferred plasticiser for inclusion in the ink absorbent layer is a polyglycol having a molecular weight not exceeding about 350, particularly a polyethylene glycol-such as, di-, tri- or tetra-ethylene glycol.

The amount of plasticiser to be blended with the ink absorbent resin may vary over a wide range but is readily established by simple experimentation. Conveniently the plasticiser comprises from 1 to 50, preferably from 2 to 30, and particularly preferably from 10 to 20, per cent by weight of the ink absorbent resin.

To improve the ageing behaviour of the resin layer and promote absorption and drying of a subsequently applied ink, a surfactant may, if desired, be incorporated into the resin layer. A cationic, surfactant, such as a quaternary ammonium salt, is suitable for this purpose. Additionally a humectant, such as glycerol, may be employed.

If desired, the ink-absorbent layer may additionally comprise a particulate filler to improve the handling characteristics of the sheet. Suitable fillers include silica, desirably of a particle size not exceeding 20, and preferably less than 12, for example 8, microns. The amount of filler employed will be dictated by the desired characteristics of the sheet but will generally be low to ensure that the optical characteristics (such as haze) of the sheet remain unimpaired. Typical filler loadings are of the order of less than 0.5, and preferably from 0.1 to 0.2, percent by weight of the resin component(s).

The ink absorbent layer is conveniently applied to the base sheet by a conventional coating technique—for example, by deposition from a solution or dispersion of the resin(s) in a volatile medium, such as an aqueous or organic solvent medium.

Drying of the applied ink absorbent resin layer may be effected by conventional drying techniques—for example, by suspending the coated base sheet in a hot air oven maintained at an appropriate temperature. A drying temperature of about 120° C., is usually suitable for a polyester base sheet.

The thickness of the dry ink-absorbent resin layer may vary over a wide range but is conveniently within a range of from 2 to 25 microns, and preferably from 3 to 10, for example 6, microns.

A base sheet suitable for use in the production of an inkable sheet recording to the invention may comprise paper, cloth, or any other material normally employed in the production of ink recording sheets. However, a desirable base sheet comprises any polymeric material capable of forming a self-supporting opaque, or preferably transparent, film or sheet.

By a "self-supporting film or sheet" is meant a film or sheet capable of an independent existence in the absence of a supporting substrate.

Suitable polymeric materials for use in the production of a base sheet are usually thermoplastics polymers, and include cellulose esters, e.g. cellulose acetate, polystyrene, polyamides, polymers and copolymers of vinyl chloride, polymers and copolymers of olefines, e.g. polypropylene, polysulphones, polycarbonates and particularly linear polyesters which may be obtained by condensing one or more dicarboxylic acids or their lower alkyl (up to 6 carbon atoms) diesters, e.g. terephthalic acid, isophthalic acid, phthalic acid, 2,5-, 2,6- and 2,7- napthalene dicarboxylic acid, succinic acid, sebacic acid, adipic acid, azelaic acid, diphenyldicarboxylic acid and hexahydroterephthalic acid or bis-p-carboxyl phenoxy ethane (optionally with a mono-carboxylic acid, such as pivalic acid) with one or more glycols, e.g. ethylene glycol, 1,3-propanediol, 1,4-butanediol, neopentyl glycol and 1,4-cyclohexane-dimethanol. A biaxially oriented and heat-set film of polyethylene terephthalate is particularly useful as a base sheet for the production of an inkable sheet according to the invention and may be produced by any of the processes known in the art, e.g. as described in British patent specification No. 838 708.

The base sheet is suitably of a thickness from 25 to 300, particularly from 50 to 175 and especially from 75 to 125 microns.

To promote adhesion of the resin layer to a base sheet, particularly in the case of a polymeric base sheet, it is desirable first to treat a surface of the base sheet with a priming medium. Creation of a priming layer is conveniently effected by treating a surface of the polymer base sheet with an agent known in the art to have a solvent or swelling action on the substrate polymer. Examples of such conventional agents, which are particularly suitable for the treatment of a polyester substrate, include a halogenated phenol dissolved in a common organic solvent e.g. a solution of p-chlorometacresol, 2,4-dichlorophenol, 2,4,5- or 2,4,6-trichlorophenol or 4-chlororesorcinol in acetone or methanol. In addition, and preferably, the priming solution may contain a partially hydrolysed vinyl chloride-vinyl acetate copolymer. Such a copolymer conveniently contains from 60 to 98 per cent of vinyl chloride, and from 0.5 to 3% of hydroxyl units, by weight of the copolymer. The molecular weight (number average) of the copolymer is conveniently in a range of from 10,000 to 30,000, and preferably from 16,500 to 25,000.

If desired, a plurality of priming layers may be sequentially applied to a base sheet.

The priming agent is suitably applied at a concentration level which will yield a priming layer having a relatively thin dry coat thickness—for example, generally less than 2 microns, and preferably,less than 1 micron.

An inkable sheet according to the invention is particularly suitable for use in the preparation of inked transparencies for use in a transmission mode, for example—with an overhead projector. Retention in the resin layer of the solvent medium of an applied ink ensures rapid drying of the ink, and facilitates immediate use of the imaged sheet.

Figure 1:
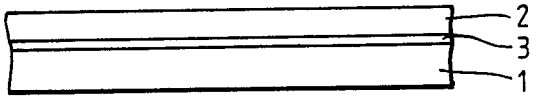
FIG. 1 is a schematic elevation (not to scale) of a portion of an inkable sheet comprising a polymeric base sheet 1 to one surface of which an ink-absorbent resin layer 2 is bonded by an intermediate primer layer 3.
Figure 2:
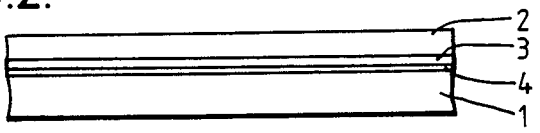
FIG. 2 is a fragmentary schematic elevation of a similar sheet in which an additional layer 4 of a priming medium is provided at the interface between base sheet 1 and primer layer 3.
Figure 3:
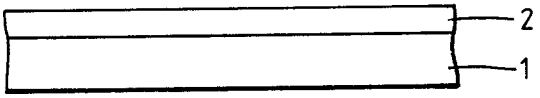
FIG. 3 is a fragmentary schematic elevation of a similar sheet in which an absorbent resin layer 2 is bonded directly to a surface of an unprimed base sheet 1.

The invention is further illustrated by reference to the following Examples.

EXAMPLE 1

Each surface of a biaxially oriented, uncoated, polyethylene terephthalate film base sheet of about 100 microns thickness was primed with a solution in acetone of p-chloro-m-cresol (3.75% weight/vol) and VINYLITE VAGH (0.75% weight/vol). VINYLITE VAGH is a co polymer of vinylchloride (90% wt %) and vinyl acetate (4 wt%) with 2.3 wt % hydroxyl content and of average molecular weight 23,000.

The primed sheet was then dried in a hot air oven maintained at a temperature of 80° C. to leave a residual prime layer of approximately 0.2 micron thickness on each surface.

Each primed surface was then coated with the following solution:

Methanol: 1000 ml
Butanol: 40 ml
Polycarboxylic Acid (ROHAGIT SNV): 60 g
Quat Ammonium salt (CYASTAT SP): 20 g
Tetraethylene Glycol: 15 ml
Glycol: 6 ml
Silica (DEGUSSA FK 320 DS): 0.12 g and the coated base sheet was dried at a temperature of 100° C. to yield a resin layer of about 6 microns thickness on each surface. The resultant sheet was flat (<10 mm corner : curl test, Example 3).

Characters printed on the resin layer using an aqueous-diethylene glycol-based ink (50:50 w/w) appeared, on projection, as clear coloured characters against a white background. The characters remained clear over a long period (>6 months) and dried at ambient temperature within 15 seconds of printing to give a non-sticky image which could be inter-leaved with paper without off-setting of the coloured printed areas. The image was resistant to washing with water.

EXAMPLE 2

The procedure of Example 1 was repeated, save that each primed surface was coated with a solution of the following composition:

Methanol: 100 ml
Isopropanol: 4.2 ml
Polycarboxylic Acid (ROHAGIT SNV): 6 g
Quat Ammonium salt (CYASTAT SP): 1.8 g
Tetraethylene Glycol: 1.5 g and the coated base sheet was dried for about 5 minutes at a temperature of 110° C. to yield a resin layer of about 6 microns thickness on each surface. The resultant sheet was flat (<10 mm corner : curl test, Example 3).

Line and dot patterns drawn with a pen plotter on the resin layer using an aqueous-diethylene glycol-based ink (50:50 w/w), were of similar appearance and behaviour to those of Example 1, the lines drying within 15 seconds of printing and the dots drying within 60 seconds of printing.

EXAMPLE 3

The procedure of Example 2 was repeated, save that each primed surface of the base sheet was coated with a solution of the following composition:

Methanol: 100 ml
Isopropanol: 4.2 ml
Polycarboxylic Acid (ROHAGIT SNV): 6 g
Quat Ammonium salt (CYASTAT SP): 1.8 g and the coated base sheet was dried for about 5 minutes at a temperature of 110° C. to yield a resin layer of about 6 microns thickness on each surface.

Line and dot patterns drawn on the resin layer using an aqueous-diethylene glycol-based ink (50:50 w/w), were of similar appearance and behaviour to those of Example 2, the lines drying within 15 seconds of printing and the dots drying in from 30 to 60 seconds of printing.

However, the coated base sheet exhibited significant curl (>30 mm corner) compared to the flat sheet of Example 2, resulting from omission of the tetraethylene glycol plasticiser, and was not acceptable for use as a pen-plotter recording sheet. Curl was assessed by allowing an A-4 sample of the coated base sheet to remain on a flat surface at ambient temperature for 1 hour, and then measuring the distance by which each corner of the sheet had lifted from the flat surface. The quoted value (>30 mm) is the average lift of the 4 corners of the sheet.

We claim:

1. An inkable sheet comprising a base sheet having on a surface thereof an ink-absorbent polymeric resin layer wherein the resin layer comprises an acrylic or methacrylic polymer containing free carboxylic acid groups and a plasticizer therefor, wherein the plasticizer comprises a polyglycol having a molecular weight not exceeding 350.

2. An inkable sheet according to claim 1 wherein said acrylic or methacrylic polymer comprises a copolymer of acrylic acid or methacrylic acid with a lower alkyl (1 to 6 carbon atoms) acrylate or methacrylate ester.

3. An inkable sheet according to claim 2 wherein said acrylic or methacrylic polymer has an acid value of from 400 to 450.

4. An inkable sheet according to claims 1–3 wherein the ink-absorbent resin layer additionally comprises at least one additive selected from a surfactant, a humectant and a particulate filler.

5. An inkable sheet according to claims 1–3 comprising at least one primer layer between the base sheet and resin layer.

6. An inkable sheet according to claims 1–3 wherein the base sheet comprises a biaxially oriented film of polyethylene terephthalate.

7. An imaged transparency for use in a transmission mode comprising a sheet according to claims 1–3 having an inked image applied to the resin layer.

8. An inkable sheet comprising a base sheet having on a surface thereof an ink-absorbent polymeric resin layer wherein the resin layer comprises an acrylic or methacrylic polymer containing free carboxylic acid groups and a plasticizer therefore, wherein the acid value of the polymer is from 400 to 450 and the plasticizer is polyethylene glycol having a molecular weight not exceeding 350.

* * * * *